US005275232A

United States Patent [19]

Adkins et al.

[11] Patent Number: 5,275,232

[45] Date of Patent: Jan. 4, 1994

[54] DUAL MANIFOLD HEAT PIPE EVAPORATOR

[75] Inventors: Douglas R. Adkins; K. Scott Rawlinson, both of Albuquerque, N. Mex.

[73] Assignee: Sandia National Laboratories, Albuquerque, N. Mex.

[21] Appl. No.: 31,514

[22] Filed: Mar. 15, 1993

[51] Int. Cl.[5] ..... F28D 15/02

[52] U.S. Cl. ..... 165/104.26; 165/115; 122/366; 159/27.1; 159/27.4; 159/906; 159/DIG. 28

[58] Field of Search ..... 165/104.26, 115; 122/366; 159/DIG.

[56] References Cited

U.S. PATENT DOCUMENTS 3,686,040 8/1972 Grover et al. ..... 165/104.26

3,977,364 8/1976 Gijsbers et al. ..... 165/104.26

*Primary Examiner*—Albert W. Davis, Jr.

*Attorney, Agent, or Firm*—Gregory A. Cone

[57] ABSTRACT

An improved evaporator section for a dual manifold heat pipe. Both the upper and lower manifolds can have surfaces exposed to the heat source which evaporate the working fluid. The tubes in the tube bank between the manifolds have openings in their lower extensions into the lower manifold to provide for the transport of evaporated working fluid from the lower manifold into the tubes and from there on into the upper manifold and on to the condenser portion of the heat pipe. A wick structure lining the inner walls of the evaporator tubes extends into both the upper and lower manifolds. At least some of the tubes also have overflow tubes contained within them to carry condensed working fluid from the upper manifold to pass to the lower without spilling down the inside walls of the tubes.

9 Claims, 1 Drawing Sheet

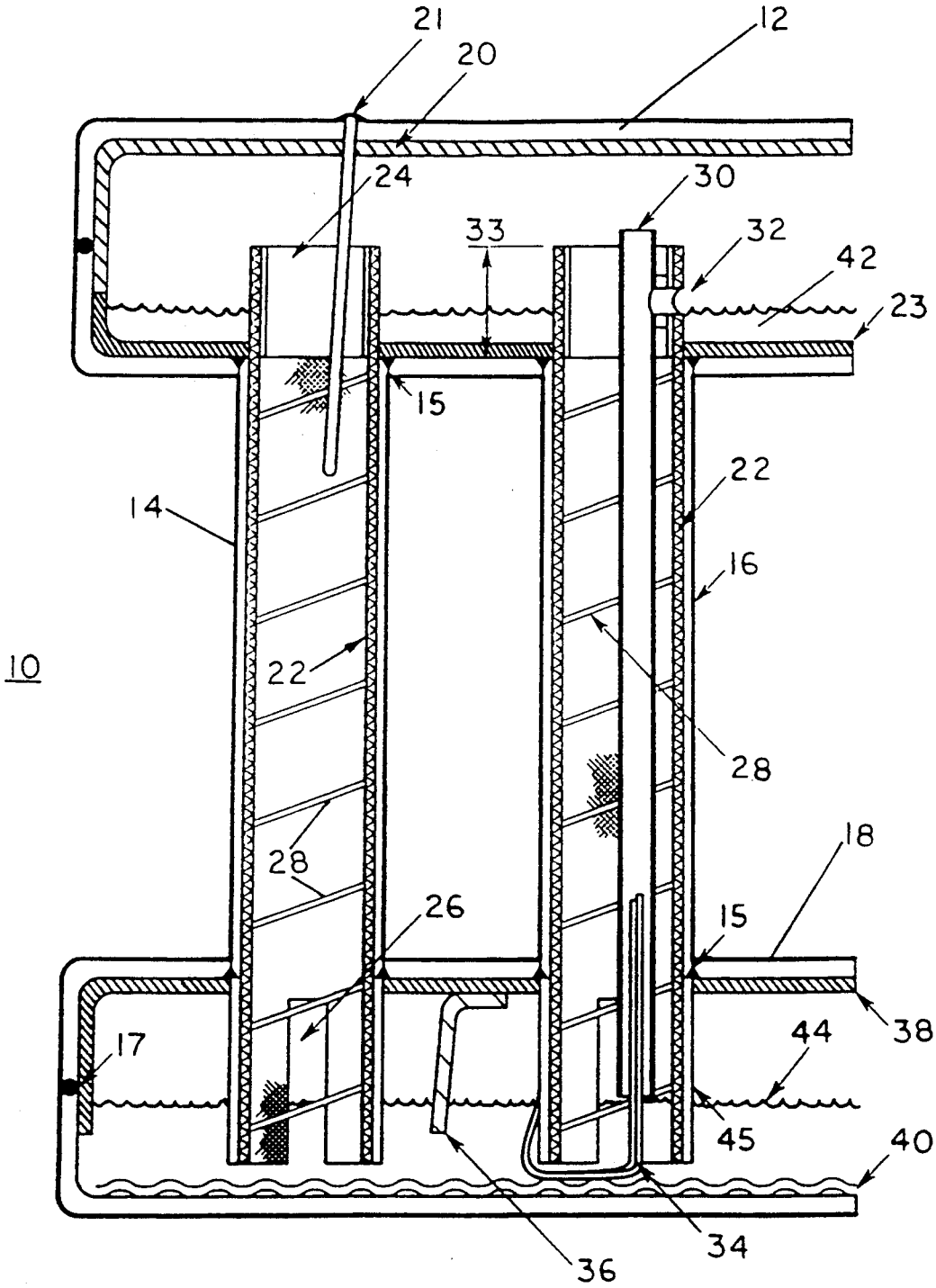
21
20
12
24
30
33
32
42
23
15
22
14
16
10
22
28
28
18
26
15
38
17
44
45
40
36
34

DUAL MANIFOLD HEAT PIPE EVAPORATOR

The government has rights in this invention pursuant to Contract No. DE-AC04-76DP00789 awarded by the Department of Energy.

BACKGROUND OF THE INVENTION

This invention relates to heat pipes. More particularly this invention relates to improvements to the evaporator section of a dual manifold evaporator with an intermediate bank of evaporator tubes.

A heat pipe is a device that transfers thermal energy by the evaporation and condensation of a working fluid that is enclosed in the evacuated heat pipe vessel. Heat from an external source is absorbed in the evaporator end of the heat pipe and acts to transform the working fluid from a liquid phase to a vapor phase. The vapor then travels to the condenser end of the heat pipe system where the vapor condenses and transfers energy to thermal equipment that is connected to the condenser. The condensed fluid then flows back to the evaporator section to begin the cycle again. The passage connecting the evaporator section to the condenser section is generally referred to as the vapor space or the adiabatic region. The working fluid is normally in a saturated state, enabling the heat pipe to operate at near uniform temperature.

To construct a compact heat pipe heat exchanger that can transfer a large quantity of energy from a distributed heat source, one solution is to use a bank of heat pipes in parallel. The individual heat pipes generally are not interconnected in these systems; the evaporator of one heat pipe leads only to the condenser of the same pipe. Such systems are used in some commercial air-to-air heat exchangers, and they have also been used in a few fuel-fired boiler systems.

In some situations, it is desirable to combine the heat input from several heat pipe evaporators and to deliver the energy to a single condenser region. In effect, such a system would collect energy from a distributed source and deliver the energy to a single destination. This has been accomplished in the past by combining the condenser ends of several heat pipes whose evaporator ends are in the hottest region of a boiler with the evaporator end of a single, larger capacity heat pipe whose condenser end passes the thermal energy to a thermal load. This method of linking heat pipes adds to the system's cost and complexity and increases the overall temperature drop through the system.

There have been a umber of attempts to combine a plurality of evaporator tubes directly with a single condenser to collect heat from a diffuse source and transfer it to a single point. None has been particularly successful due to a variety of design and performance shortcomings. The structures illustrated in FIGS. 7 and 8 of U.S. Pat. No. 3,977,364 to Gijsgers et al. for "Apparatus for Evaporating Fluids" are representative. This patent is incorporated by reference herein in its entirety. One problem in particular is caused by overflow of condensate from the upper manifold down the inner walls of the tubes which upsets the evaporation in these areas by quenching the operation of the affected tube and causing undesirable local overheating and temperature oscillations in the system.

SUMMARY OF THE INVENTION

This invention improves the performance of the evaporator section of a dual manifold heat pipe system in several ways. The extensions of the wicks into the upper and lower manifolds have been redesigned for optimal liquid transport. The portions of the upper and lower manifolds exposed to the heat source have been provided with wicks to allow for evaporation of working fluid from these surfaces as well as the evaporator tubes. Openings have been provided in the lower tube extensions into the lower manifold to allow the vapor to flow easily from the evaporation regions in the lower manifold into the evaporator tubes, up through the upper manifold and then on to the condenser. Also, the quenching of the evaporator tubes by overflow of condensate down the interior walls of the evaporator tubes is prevented by the addition of at least one overflow tube which drains condensate from the upper manifold at a level which is below the tops of the wicks extending into the upper manifold. The overflow tube passes excess fluid down into the lower manifold.

BRIEF DESCRIPTION OF THE DRAWING

The drawing FIGURE is a cross sectional view of a portion of the evaporator section of a heat pipe showing portions of the upper and lower manifolds and two of the evaporator tubes.

DETAILED DESCRIPTION OF THE INVENTION

The complete heat pipe apparatus will include a condenser section, not shown, where the vapor phase of the working fluid in the heat pipe recondenses and transfers its heat of vaporization to another object in thermal communication with the condenser. One such object can be a Stirling engine. Vapor and condensate pass back and forth between the condenser and evaporator section via a fluid conduit normally called a vapor tube. The vapor tube, not shown, can have a separate internal conduit for the return of the condensate to the evaporator. The vapor tube is attached to and in fluid communication with the upper manifold 12.

The evaporator section 10 comprises an upper manifold 12, a bank of evaporator tubes, two of which are shown 14 and 16, and a lower manifold 18. Both the upper and lower manifolds have upper and lower halves which are joined together with GTA fusion welds. The joint could also be made up by brazing or electron-beam welding. Holes were cut in the respective sections of the upper and lower manifolds for insertion and joining of the evaporator tubes. The joints were welded with electron-beam welds 15 at the interior end of the joint to prevent the collection of residual working fluid and impurities in the joint which could cause corrosion and premature failure. The upper portion of the upper manifold 12 has a condensate distribution wick 20 on its inner surface to optimize the distribution of the condensate to the actual evaporation wick 23 on the lower portion of the upper manifold wall. During some periods of operation, such as when the evaporator is first heated, there will not be a pool in the top manifold. The wick in the top manifold will help the system get through the periods when no pool exists. The pool 42 is relatively shallow, so heat will conduct through the pool and vaporize or boil off the pool's surface. The evaporation wick 23 in the upper manifold distributes liquid across the surface of the manifold wall which is in contact with the source of heat for the system, here flue gas. This evaporator wick for the upper manifold and the corresponding wick 38 in the lower manifold will find their most effective implementation in relatively high heat flux applications. The level of condensate 42 in the upper manifold will not exceed the bottom of the opening 32 in the evaporator tube 16 having the overflow tube 30. The structure 21 is a thermowell and is used for temperature measurements. It is not necessary for production versions of this device. The condensate distribution wick is, in this embodiment, four layers of 56-mesh screen. The evaporator wick for the upper manifold used herein is four layers of 200-mesh screen. The working fluid is sodium.

Several different configurations can be used for the evaporator tubes. Evaporator tubes 14 and 16 represent one preferred embodiment. The outer wall of the tubes is attached at its upper boundary to the lower portion of the upper manifold by welds as described above. In a similar fashion, the outer wall of the tubes is attached at the lower boundary to the upper portion of the lower manifold with electron-beam welds at the interior joint. Within the evaporator tubes are emplaced evaporator wicks 22 which extend above the tops of the evaporator tubes 14 and 16 up into the upper manifold past the level of the condensate pool 42. The wicks utilized herein are fabricated from 8 layers of 200-mesh screen. Support tubes 24 for these upward extensions of the evaporator wicks are placed inside the wicks from the top of the wicks at least as far down as the upper end of the evaporator tube to support the wicks and prevent unwanted leakage through the wicks and down the interior of the tubes. Liquid can still enter the evaporator wick from the condensate pool 42 in the upper manifold and be transported across the interior wall of the evaporator tube by capillary pumping and gravitational forces. At the lower end of the tubes, the wicks 22 extend down past the intersection of the tubes with the upper portion of the lower manifold far enough into the lower manifold to be continuously wetted by the pool of condensate 44 in the lower manifold. By immersing the wick in the lower pool of liquid, the wick can transport liquid up from the pool and across the interior surface of the evaporator tube by capillary pumping. Tube stubs 45 are located over the lower ends of the evaporator wicks to support the wicks.

Slots 26 are provided in the ends of the tubes and wicks to provide for easy transport of liquid to the wicks and also for the flow of vapor produced by the evaporation of working fluid from the evaporator wick 38 on the upper portion of the lower manifold 18. The slot could be replaced with a hole towards the top of the portion of the tube and wick extending down into the lower manifold to provide for flow of vapor away from the lower manifold wick 38 since the evaporator tube wick 22 will in most instances be adequately wetted without the need for the slot 26. Alternate embodiments could use a wick support tube in the lower manifold which is similar to support tube 24 that is used in the upper manifold. A hole toward the top portion of the support tube and the wick extension in the lower manifold would still be required in the alternate configuration to vent vapor away from the lower manifold wick 38. In another configuration for the system, the evaporator tubes could extend into the lower end of the evaporator to the level that the lower wick extensions are presently illustrated. It would then be necessary to cut the vent slots or holes in the extended portion of the evaporator tube.

By extending the evaporator tubes into the lower manifold and a short distance into the upper manifold, it would be possible to braze the evaporator tubes on the interior side of the lower portion of the upper manifold and the upper portion of the lower manifold as an alternative to electron-beam welding. Also the construction illustrated in the Gijsgers patent could be employed wherein the upper ends of the tubes would extend up into the upper manifold to the level of the wick extensions presently illustrated. The wicks would be then modified to come up over the top of these extended tubes and drape down the outsides of the extended tubes into the condensate 42. The inner support tubes 24 would not be needed in this embodiment. The wicks herein are fabricated of multiple layers of screen mesh; however, other materials such as formed powder could be used. The evaporator wicks used herein are pressed against the inner walls of the evaporator tubes by support springs 28. This is done to hold the wicks in place during a following sintering in which the entire assembly is heated up to the point where diffusion bonding will occur between the wick and the tube wall. The spring then becomes superfluous and has lost its temper in any event. In situations which omit this sintering step, the springs or apparatus with similar structure are still necessary.

Two of the important advances of the system disclosed herein is the provision of the overflow tube 30 and the construction of the evaporator wick structure in the lower manifold. Testing of a prototype without the overflow tube indicated that the system was overflowing condensate from the upper manifold down the interior of the evaporator tubes. An excess of condensate on the evaporator surface can block the flow of heat and create hot spots on the outside surface of the evaporator tube. This can cause undesirable oscillations in the temperature within the heat pipe system and also damage the evaporator tubes. The overflow tube 30 connects to the hole 32 in the side of the wick extension in the upper manifold and establishes the upper level of the condensate 42 in the upper manifold thereby preventing overflow over the tops of the wick extensions onto the inside walls of the evaporator tubes. The lower end of the overflow tube extends past the high heat flux portion of the evaporator tube and is optionally provided with a drain wick 34 to assist in condensate transfer out of the overflow tube. These overflow tubes are not necessarily required for each evaporator tube; the preferred practice would be to employ only as many as are needed to prevent overflow. As an alternate embodiment, the overflow tube could be a separate fluid conduit apart from the evaporator tubes and could communicate directly through the wall of the upper manifold at an appropriate level down into the lower manifold. The construction of the lower extensions of the evaporator tube wicks into the lower manifold provides a path for liquid in the lower pool 44 to travel up to the heated areas by capillary pumping. Normally, these wick extensions will be in continuous contact with the pool of liquid 44. However, brief periods in which the wick extensions are not in contact with the lower pool will not adversely affect the function of the evaporator so long as there is sufficient working fluid in the high heat flux section of the evaporator tube coming from the upper manifold pool 42.

The lower manifold has a lower manifold evaporator wick 38 to take advantage of the heat transfer across the upper portion of the lower manifold which is exposed to the heat source. The lower ends of the wick 38 extend down into the liquid 44. Further condensate transfer into the wick 38 is provided by the manifold wick supply 36, several of which may be provided within the lower manifold. An optional zirconium sheet 40 is provided at the bottom of the lower manifold to getter oxides from the liquid metal working fluid.

We claim:

1. Heat pipe apparatus comprising:

a working fluid;

means to condense the fluid;

means to transport fluid between the condenser means and evaporator means; and evaporator means comprising:

an upper manifold means in fluid communication with a multiplicity of evaporator tube means;

a multiplicity of evaporator tubes, each comprising an upper portion sealingly fastened to and communicating with the upper manifold means, a lower portion sealingly attached to and communicating with a lower manifold means and having evaporator tube wick means located against the inside wall of the tube means and extending into the upper and lower manifold means;

at least one overflow tube means for transporting fluid from the upper manifold to a lower manifold to prevent the level of condensate in the upper manifold means from rising above the top of the evaporator tube wick means which extend into the upper manifold; and a lower manifold means.

2. The apparatus of claim 1 wherein each of the evaporator tubes terminate at or slightly above their junctions with the upper manifold means and the evaporator tube wick extensions into the upper manifold are supported on their interiors by upper support tube means which also act to prevent non-capillary flow of condensate through the wick extensions into the interior of the evaporator tubes.

3. The apparatus of claim 1 wherein each of the evaporator tubes extends into the upper manifold to the height of the wick extensions and wherein the wick extensions extend over the top edges of the evaporator tubes and back down along the outside surface of the evaporator tubes such that contact of the wicks with the condensate in the upper manifold is maintained.

4. The apparatus of claim 1 wherein each of the evaporator tubes terminates at or slightly below its junction with the lower manifold means and the evaporator tube wick extensions into the lower manifold are supported by lower support tube means such that the bottom portions of the wick extensions are in essentially continuous contact with the condensate in the lower manifold.

5. The apparatus of claim 4 wherein is provided a opening between the interior of the wick extension and the lower manifold above the level of the condensate in the lower manifold to provide for vapor flow from the lower manifold into the extension tube.

6. The apparatus of claim 1 wherein each of the evaporator tubes at its lower end extends down into the lower manifold to approximately the same depth as the lower extension of the evaporator tube wick such that the bottom portion of the lower extension of the wick is in essentially continuous contact with the condensate in the lower manifold.

7. The apparatus of claim 1 wherein the lower manifold further comprises lower manifold evaporator wick means located against the interior wall of the lower manifold.

8. The apparatus of claim 1 wherein at least one of the overflow tube means is located within one of the evaporator tubes and communicates with the upper manifold through an opening in the side of the evaporator tube which is located below the top of the upper extension of the evaporator tube wick means.

9. The apparatus of claim 1 wherein the evaporator tube wicks means are urged against the interiors of the tubes by spiral spring means.

* * * * *